US007051959B2

(12) United States Patent
Lim

(10) Patent No.: US 7,051,959 B2
(45) Date of Patent: May 30, 2006

(54) MULTI-PURPOSE HAND HELD SPRAYER HAVING A VERTICAL SHUT-OFF VALVE

(76) Inventor: Howard Tak Su Lim, 12210 Rives Ave., Downey, CA (US) 90242

( * ) Notice: Subject to any disclaimer, the term of this patent is extended or adjusted under 35 U.S.C. 154(b) by 337 days.

(21) Appl. No.: 10/731,180

(22) Filed: Dec. 9, 2003

(65) Prior Publication Data

US 2005/0121542 A1 Jun. 9, 2005

(51) Int. Cl.

| | |
|---|---|
| ***A62C 2/08*** | (2006.01) |
| ***A62C 37/08*** | (2006.01) |
| ***B05B 1/14*** | (2006.01) |
| ***E21F 5/04*** | (2006.01) |
| ***F23D 11/38*** | (2006.01) |

(52) U.S. Cl. ..... 239/548; 239/525; 239/526; 239/532; 239/600

(58) Field of Classification Search ..... 239/569, 239/525, 526, 532, 600
See application file for complete search history.

(56) References Cited

U.S. PATENT DOCUMENTS

| | | | | |
|---|---|---|---|---|
| 591,228 | A | | 10/1897 | Goltermann |
| 889,952 | A | | 6/1908 | McGinley |
| 1,611,241 | A | | 12/1926 | Sanford |
| 1,677,446 | A | | 7/1928 | Sanford |
| 2,369,356 | A | | 2/1945 | Koehn |
| 2,457,993 | A | | 1/1949 | Fletcher et al. |
| 2,622,841 | A | | 12/1952 | Held |
| 2,758,873 | A | | 8/1956 | Leisenring |
| 2,939,675 | A | | 1/1960 | Karden |
| 2,945,703 | A | | 1/1960 | Ballard |
| 2,959,391 | A | | 11/1960 | Rapaport |
| 2,969,809 | A | | 1/1961 | Klingler |
| 3,140,830 | A | | 7/1964 | Ingold |
| 3,321,178 | A | | 5/1967 | Pinke et al. |
| 3,565,344 | A | | 2/1971 | Takei |
| 3,768,734 | A | | 10/1973 | Anderson, Jr. et al. |
| 3,866,839 | A | * | 2/1975 | Magner ..... 239/416.5 |
| 3,904,116 | A | | 9/1975 | Jones |
| 3,993,250 | A | | 11/1976 | Shure |
| 4,128,209 | A | | 12/1978 | Johnson |
| 4,171,169 | A | | 10/1979 | Williams |
| 4,260,130 | A | | 4/1981 | Brehm |
| 4,286,616 | A | | 9/1981 | Botnick |
| 4,396,154 | A | | 8/1983 | Iovino et al. |
| 4,544,133 | A | | 10/1985 | Collins |
| 4,545,533 | A | | 10/1985 | Botnick |
| 4,635,856 | A | | 1/1987 | Reed |
| 4,958,754 | A | | 9/1990 | Dennis |
| 5,050,802 | A | * | 9/1991 | Gill et al. ..... 239/224 |

(Continued)

*Primary Examiner*—David A. Scherbel
*Assistant Examiner*—James S. Hogan

(57) ABSTRACT

This invention relates to a hand held sprayer that delivers fluid with a solid stream or various patterns of multiple streams, comprising a controller, an extension bar, and a spray tip for multi-purpose usages. The controller incorporates a vertical shut-off valve to control the flow from a pressurized inlet source to the outlet, wherein the vertical shut-off valve enables the user to get instant access of fluid supply by manually regulating a pushbutton. A movable stem assembly is engaged with a seat in the valve, being urged in a closed position by the pressures relieved from a compression spring and the inlet fluid. A bottom cover that supports the compression spring is secured to a housing body with an O-ring to seal, and a top cover is adjustably placed to lock an O-ring for obtaining a sealing and an appropriate movement of the stem assembly.

14 Claims, 7 Drawing Sheets

U.S. PATENT DOCUMENTS 5,064,170 A 11/1991 Feyen
5,735,467 A * 4/1998 Lee ..... 239/414
5,992,823 A 11/1999 Hung-Lin
6,269,821 B1 * 8/2001 Berke et al. ..... 132/317
6,422,485 B1 * 7/2002 Hsu ..... 239/526
6,502,766 B1 1/2003 Streutker et al.
2004/0188551 A1 * 9/2004 Evans ..... 239/569

* cited by examiner

W
D
802
803
716
719
78

712
713
715
716
802
803
805
78
89
70
71
80

10
712
713
715
716
10
78
89
70
71
80

MULTI-PURPOSE HAND HELD SPRAYER HAVING A VERTICAL SHUT-OFF VALVE

BACKGROUND OF THE INVENTION

1. Field of Invention

This invention relates to a fluid spraying apparatus, and more particularly to a manually operable device having a vertical shut-off valve, engaging in spraying fluid for multiple purposes.

2. Description of Related Art

A variety of sprayers with various control valves have been issued for spraying fluid. Most of the hand sprayers are generally used to spray fluid in fine droplets with the use of a nozzle. The trigger of the sprayer activates and drives the fluid into the nozzle for spraying. In another device a pressurized container is attached to the sprayer to release the fluid. These types of sprayers do not supply enough fluid to use for hygienic purposes.

There is a spraying apparatus that provides a shower for a bath in which the body is sprayed with fine streams of fluid from a perforated nozzle. The nozzle has a large head with a cover plate containing small holes for spraying fluid. This large sized head of the apparatus becomes an impediment when it is used in the limited area passed through the narrow space. The spraying apparatus is generally not equipped with any shut-off valve on the body. These features are inconvenient whenever the instant fluid supply is necessary.

There are numerous shut-off valve systems available to supply fluid for frequent usages. Some systems contain complicated configurations, hindering manufacturers from their productions. Some systems are too delicate to endure high pressures delivered from the inlet source. Other systems include structures for specific purposes so that the users have difficulties to utilize for different purposes. For example, a sprayer for cleaning dishes in the kitchen has a shut-off valve equipped with a trigger handle near the head of the angled body. This feature is not convenient when the users need to supply fluid to a distant area with a remotely regulating method. The structure that the shut-off valve is built in an angled part of the body elevates the dimensions of the sprayer. The bulky type of sprayer does not fit for being placed into a limited space through a narrow opening.

This invention delivers fluid to any area for instant access. It delivers fluid to a near area as a handy sprayer. It delivers fluid to a distant area as a remote sprayer. The sprayer can be placed to a remote area through a limited space. The slim and lengthy body of the invention allows this placement possible. The easily separable components in a quick connection afford diversity of usages and the length is adjusted through a selective extension bar. The spraying pattern is accustomed through a chosen spray tip. Fluid can be supplied either with spouting in a single stream from the extension bar or with spraying in multiple streams from the spray tip. The single stream fluid has powerful pressures to do spot cleaning. The various spraying patterns add flexibility and convenience for a multi-purpose sprayer.

The vertical shut-off valve in the invention enables the user to use the sprayer at any time. The durable structure of the valve is designed to endure high pressures from the inlet fluid source. The configuration of the valve system overcomes a common problem of leakage under the high pressures. The unsophisticated valve assembly gives benefits to the user for maintenance. All the components can be made of plastics for lower cost or metals to achieve durability. The arrangement of the shut-off valve can be applied to any apparatus for requiring instant access of fluid or any other types of fluid in the industry.

SUMMARY OF THE INVENTION

The multi-purpose hand held sprayer comprises a controller incorporating a vertical shut-off valve, an extension bar, and a spray tip. The external body of the sprayer takes a longitudinal and slim shape for facilitating placement in limited space through a narrow opening. The contour of the sprayer is deliberated to place the sprayer in a holder with little efforts. The controller has an inlet coupler to connect to a pressurized fluid source. The outlet of the controller has an adapter for a quick connection to the extension bar, obtaining a single solid stream of fluid spouted. The extension bar is additionally utilized for the quick connection to an adapter of a spray tip to get various patterns of spray. All the adapters at the joint areas have multiple sizes of diameters and require O-rings for sealing and friction. The quick connection for coupling two components enables a quick assembly and rotation for the multi-purpose usages. A variety of extension bars and spray tips are selected to fit to the individual requirements.

The vertical shut-off valve in the controller has a housing and a pushbutton for regulating the fluid flow. The housing comprises an upper chamber and a lower chamber divided by a seat. An inlet is located in the lower chamber, leading to the inlet coupler of the controller to receive pressurized fluid. An outlet in the upper chamber contains fluid released from the lower chamber, which is directed to the outlet of the controller. The upper chamber and the lower chamber embrace a manually movable stem assembly for a valve function.

The stem assembly is engaged with a seat by the pressures released from a compression spring and the pressurized inlet fluid. The pressures urge the stem assembly into the closing position against the seat. The stem assembly is composed of an elastic O-ring placed between an upper member and a base plate secured by a fastener. The O-ring has an exposed area from surrounding grooves of the upper member and the base plate. The width of the exposed area is for engagement with the seat and should be less than the thickness of the O-ring to keep in the place. The seat is located in between the upper chamber and the lower chamber, secured to the housing with an elastic O-ring for sealing. The lower chamber has a bottom cover secured to the housing with an O-ring. The bottom cover has a slot for placing the compression spring to urge the stem assembly. The upper chamber has a channel connected to an opening located above. The opening is threadably secured with a top cover that has a hole in the middle. The top cover applies pressures on an elastic O-ring located underneath. The pressures are adjusted to get an optimum sealing and friction of the stem assembly against the O-ring. The channel on the upper chamber and the hole on the top cover allow the upper member of the stem assembly to be passed through to join a pushbutton assembly. The pushbutton is manually depressed to open the stem assembly to release the fluid. The body of the pushbutton is secured with a locknut, wherein the locknut is located in an opening that is covered with a finish plug.

BRIEF DESCRIPTION OF THE DRAWINGS

FIG. 4 is a prospective view of a vertical shut-off valve isolated from the controller in FIG. 3 showing a profile of outer elements.

DESCRIPTION OF THE PREFERRED EMBODIMENTS

Figure 1:
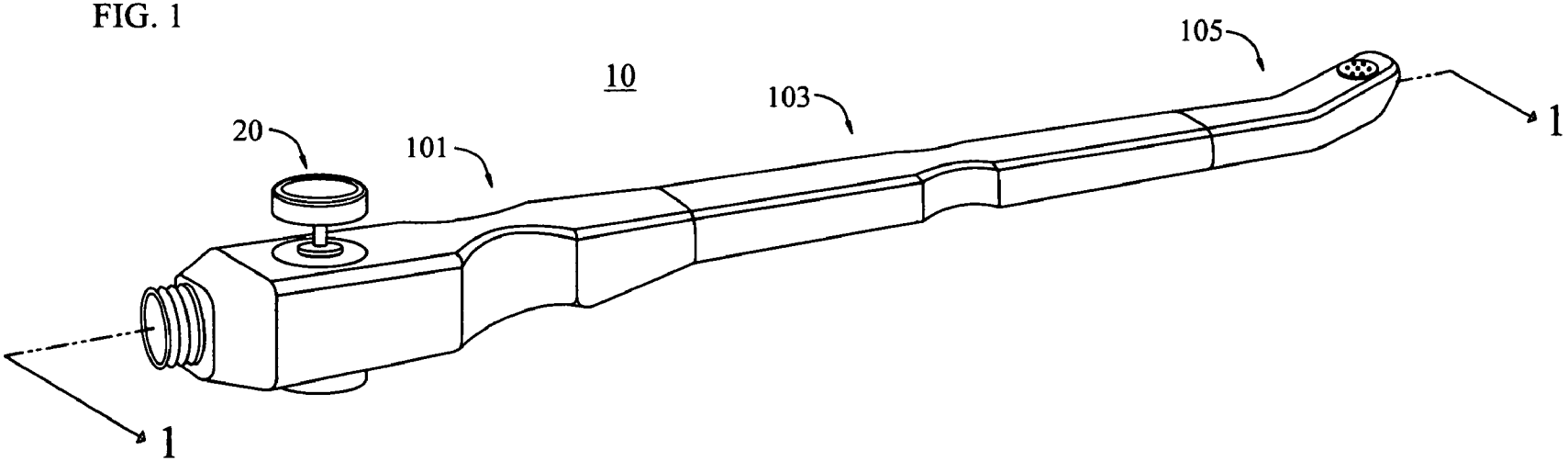
FIG. 1 is a prospective view of the invention showing the multi-purpose hand held sprayer having a vertical shut-off valve.

Reference is now made in detail to the present invention, examples of which are illustrated in the accompanying drawings wherein reference numerals having the same first two digits indicate related elements, such as 10 and 101. The numerals having the same first three digits indicate same components with different elements, such as 101 and 1017. General structures of the invention will be described following by the details and the function of components. Referring to FIG. 1, a prospective view of the present invention, a multi-purpose hand held sprayer having a vertical shut-off valve, or namely a "sprayer", is shown as an assembled one and indicated by the number 10. The sprayer 10 is composed of a controller 101 incorporating a vertical shut-off valve 20, an extension bar 103, and a spray tip 105. The exterior of the body takes a slim and sleek shape for the purpose of placing in a remote area through a limited space.

Figure 2:
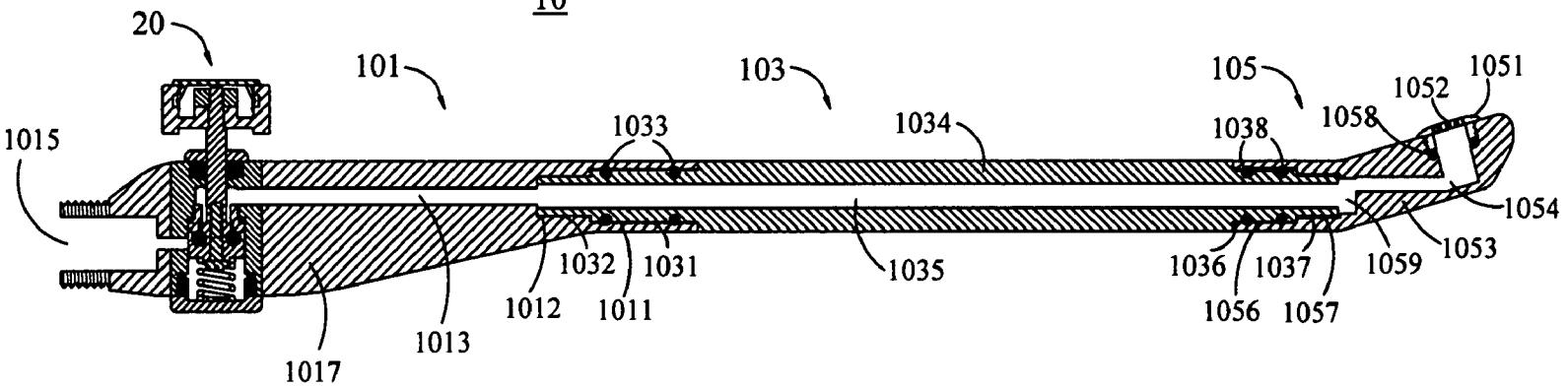
FIG. 2 is a sectional view taken on the line 1—1 in FIG. 1 displaying the internal passage from the inlet to the outlet.
Figure 3:
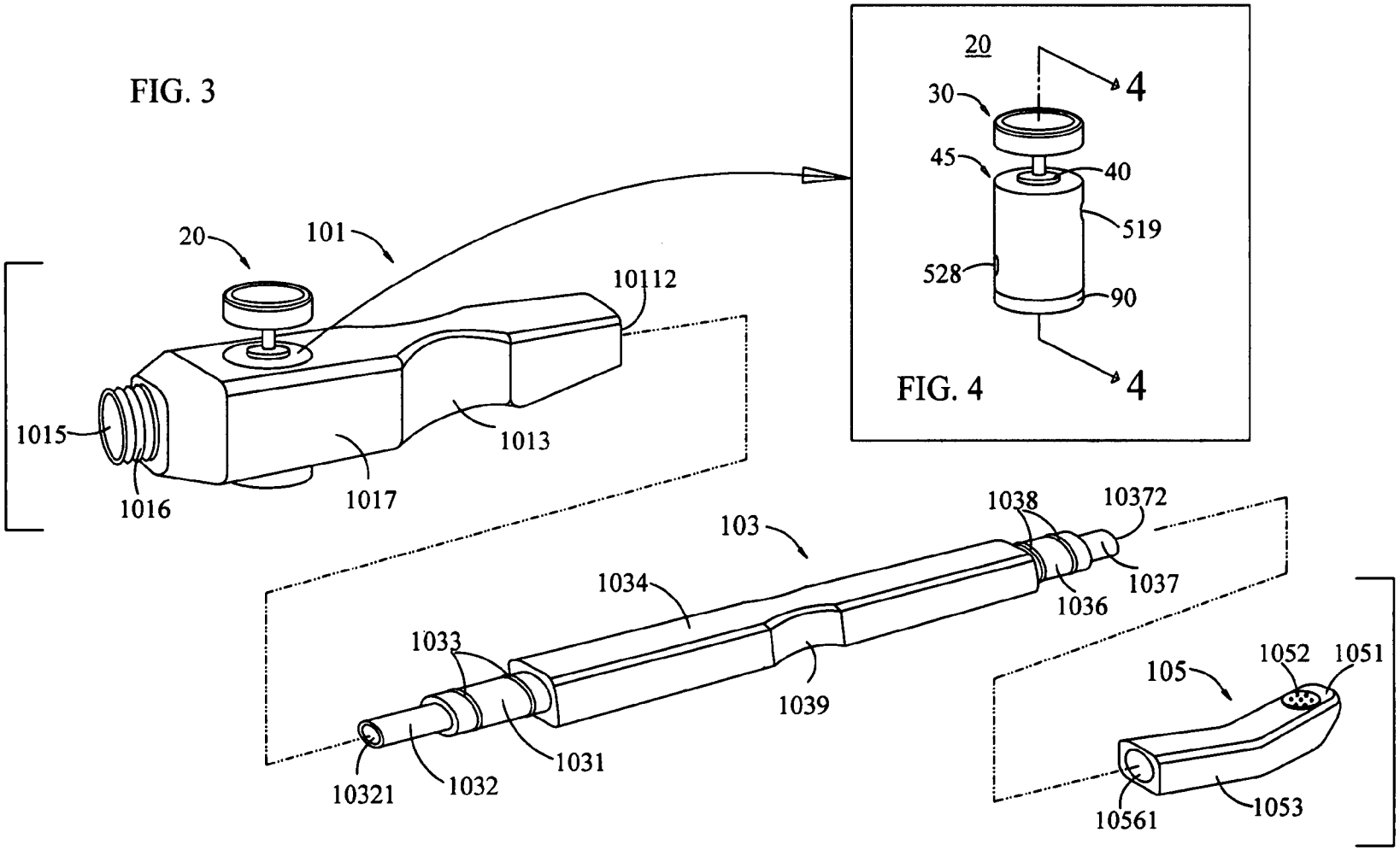
FIG. 3 is an exploded view of FIG. 1, wherein a controller, an extension bar, and a spray tip—these three components are disassembled, showing the joining elements for a quick connection.

The sprayer 10 in FIG. 2 shows internal structures of the components connected each other. The exploded view of FIG. 3 shows the individual components of FIG. 1 that are separated apart. An inlet 1015 of the controller 101 in FIG. 2 is leading to an outlet channel 1013 through a vertical shut-off valve 20, or namely a "valve". The valve 20 controls the fluid from the inlet 1015 flowing to the outlet channel 1013 of the body 1017. The outlet channel 1013 in FIG. 2 of the controller 101 has a female outlet 10112 in FIG. 3 at the end. The female outlet 10132 in FIG. 3 has two staged internal diameters 1011,1012 in FIG. 2 for connection to the extension bar 103. The female outlet 10132 is coupled with a male inlet 10351 of the extension bar 103 using a quick connection. The male inlet 10351 of the extension bar 103 has two staged diameters 1031,1032 for coupling to the female outlet 10132 of controller 101 as shown in FIG. 2. The O-rings 1033 are placed in the grooves of the male adapter to offer sealing and friction in the joining area. A male outlet 10352 of the extension bar 103 also has two staged external diameters 1036, 1037 for coupling to a spray tip 105 as in FIG. 3. It has O-rings 1038 placed in the grooves to offer sealing and friction in the joining area as the male inlet 1035 does. The male outlet 10352 is then coupled with a female inlet 10561 of the spray tip 105 using the same quick connection. The female inlet 10561 of the spray tip 105 also has two staged diameters 1056,1057 for coupling to the male outlet 10352 of the extension bar 103. A chamber 1059 in FIG. 2 is placed in the inlet of spray tip 105 after the outlet of extension bar 103. This chamber is a small reservoir buffering two joining channels that are not aligned each other. The spray tip 105 contains a plug 1051 that has multiple small openings 1052 for spraying fluid in the air. The plug 1051 is secured into the body 1053 of the spray tip 105 with an O-ring 1058 on the internal base to seal.

The components of the sprayer 10 are coupled using a quick connection. The quick connection defines that one male adapter is placed into the other female opening with sliding motion. The multiple staged male adapter supports easier and better connection than the single staged adapter to the female opening, because the male adapter with a smaller diameter serves as a guide for speedy coupling. The quick connection affords a fast and easy attachment of two components. It also affords ability for spinning of the components while attached, aligning them in various positions. Multiple elastic O-rings with various sizes of thickness support to seal the linkage and to adjust friction for the connection. The low pressures in the outlet channels enable this type of quick connection that requires less tightening stress. However, the coupling of two components can be done using any other joining technique such as a threading method. The male outlet and the female inlet for coupling can be changeable using opposite sex such as the female outlet and male inlet.

The prospective view of the controller 101 in FIG. 3 comprises a controller body 1017, an inlet 1015 with an inlet coupler 1016 for connecting to a pressurized fluid source, an outlet 10112 for released fluid, a contour 1013 for placing in a holder, and a vertical shut-off valve 20 incorporated into the controller body 1017. The valve 20 regulates the fluid flowing from an inlet 1015 to the outlet 10112. The isolated valve 20 shown in FIG. 4 will be later described in greater details.

Figure 5:
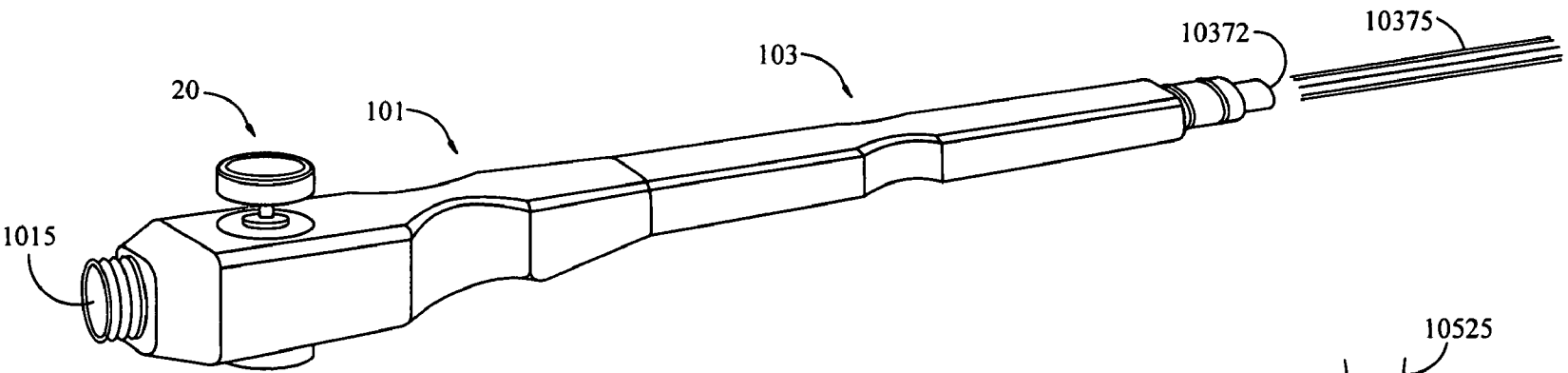
FIG. 5 is a prospective view of the sprayer, wherein the controller is connected to the extension bar having a single solid stream spouted.

The extension bar 103 in FIG. 3 is comprises a body 1034 with a contour 1039 for placing in a holder, a male inlet 10321, and a male outlet 10372. The male inlet 10321 and the male outlet 10372 contain a double staged adapter-one with smaller diameter 1032 and the other with larger diameter 1031-at each end. The double staged adapter has grooves for O-rings 1033 furnished for sealing and a quick connection. The male inlet 10351 of the extension bar 103 is connected to the female outlet 10112 of the controller 101 to receive expelled fluid from the valve 20. The extension bar 103, as shown in FIG. 5, carries the fluid to its outlet 10372 spouting a solid stream 10375 at the end. The pressures of solid stream can be adjusted through the valve control. Its maximum pressures with full opening of the valve 20 can be utilized for spot cleaning or quantity supplying. The extension bar takes a variety of length and shape for individual preference. The body with slim and long shape can be reached to a remote area and placed in a limited space.

Figure 6:
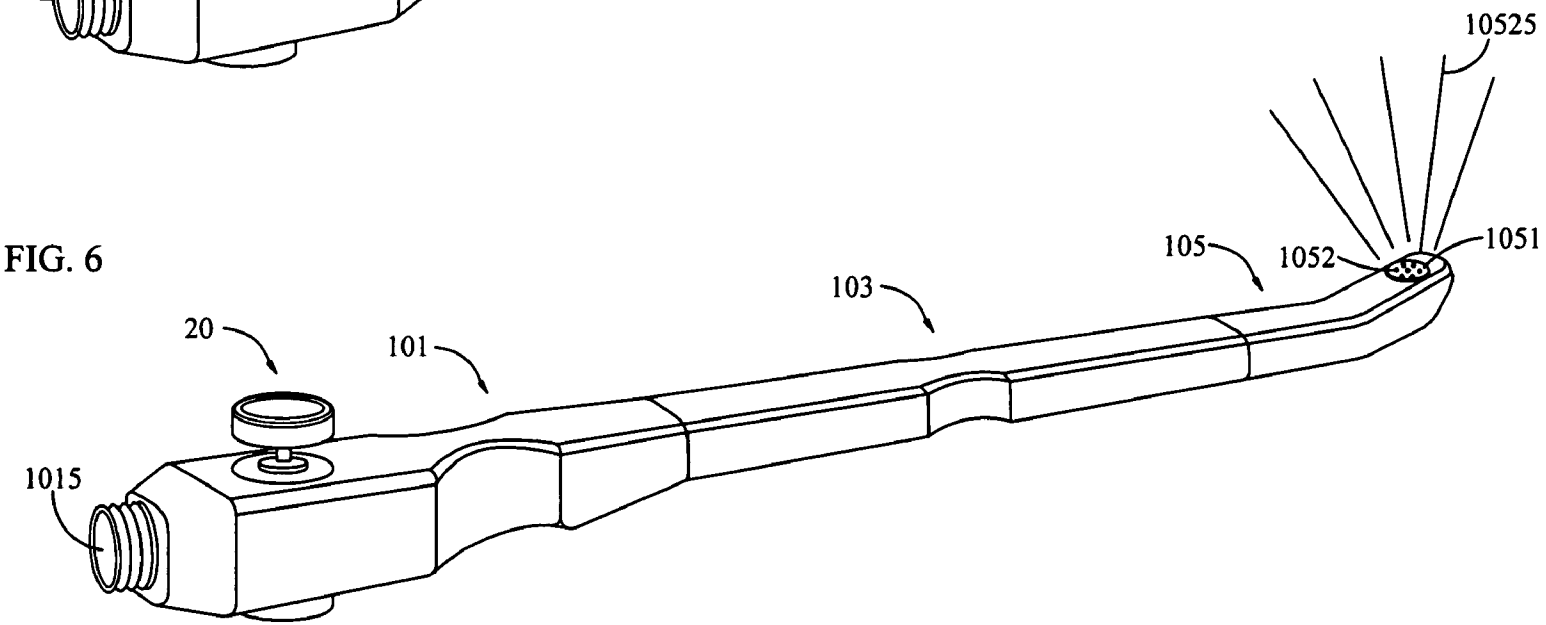
FIG. 6 is a prospective view of the sprayer, wherein the controller in FIG. 5 is furthermore connected to an angled spray tip having a multiple streams of fluid.

The male outlet 10372 of the extension bar 103 in FIG. 3 is furthermore connected to the female inlet 10561 of the spray tip 105 for multiple fluid streams 10525 in the air, as shown in FIG. 6. The spray tip 105 has a plug 1051 that contains small multiple openings 1052. The various patterns of spraying streams from the spray tip 105 can be achieved by changing the plug 1051 that holds a variety of openings with different sizes. The body 1053 in FIG. 3 of the spray tip 105 can be curved at an angle as shown in FIG. 6 to achieve a certain degree of spray in the air for various purposes. The spray tip 105 can take a body forming slim and sleek exterior for being placed into a limited space.

The vertical shut-off valve 20 is shown in FIG. 4 with being isolated from the body 1017 of the controller 101 in FIG. 3. The valve 20 comprises a pushbutton assembly 30 for manual operation and a housing 45 for controlling the flow. The exterior of the housing 45 includes a top cover 40, a bottom cover 90, an inlet opening 528, and an outlet opening 519 as shown in FIG. 4. All the components of the valve 20 are shown in FIG. 7 as an exploded view made in accordance with the present invention.

Figure 7:
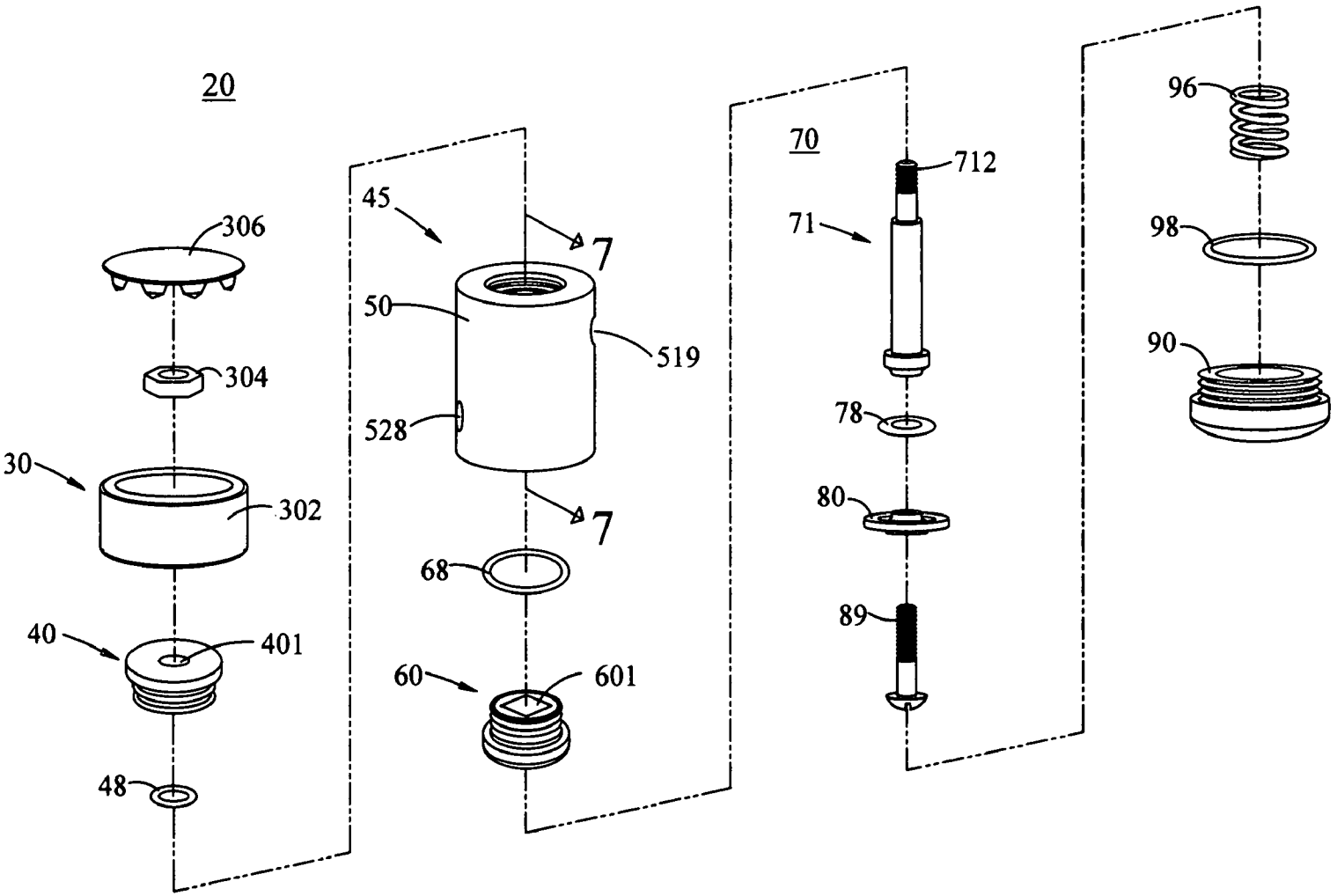
FIG. 7 is an exploded view of the vertical shut-off valve in FIG. 4 made in accordance with the present invention.
Figure 8:
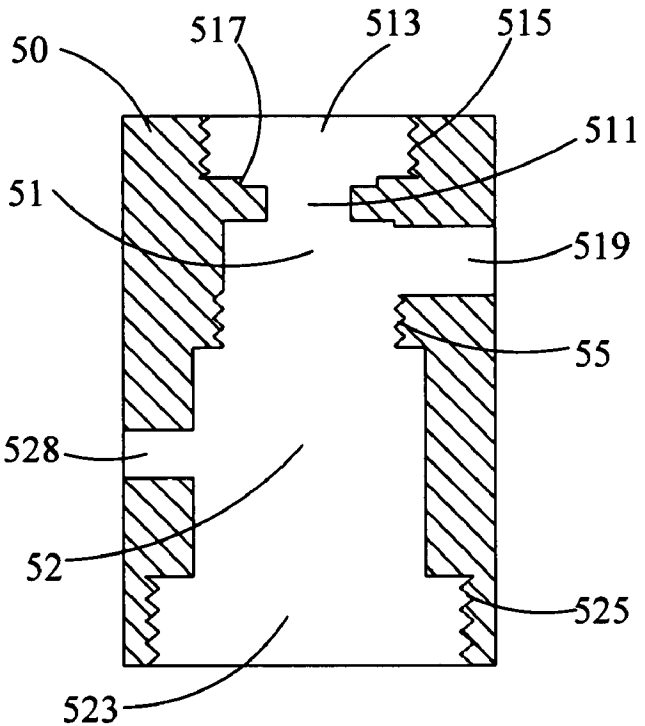
FIG. 8 is a cross-sectional view of a housing body of the vertical shut-off valve taken on the line 7—7 in FIG. 7 without the internal components assembled.

The housing 45 of the valve 20 in FIG. 7 has a housing body 50 in FIG. 8 that contains an internal structure for vertically movable valve function, creating a vertical shut-off valve. The vertical shut-off valve simplifies the valve structure to yield benefits for production and consumption. It facilitates the valve operation, because the vertical motion of the valve control is aligned with a manual depression movement. It may adopt a trigger handle that implements a leverage to gain valve operation force. The body 50 in FIG. 8 has two chambers—an upper chamber 51 and a lower chamber 52—divided by a threaded neck 55 in the middle. The upper chamber 51 is located on the top of the threaded neck 55, containing a small outlet opening 519, which is leading to the outlet 10112 of the controller 101 in FIG. 3. A large opening 513 in FIG. 8 above the upper chamber 51 has a thread 515 for placing a top cover 40 in FIG. 7. A hollow 517 in FIG. 8 is located on the bottom of the opening 513 for placing an O-ring 48 in FIG. 7 to seal. The hollow 517 makes a limitation for the O-ring 48 to get deformed toward the outside when the pressures are applied on. Therefore, the deformation of the O-ring is made toward the center, affording better sealing around an upper member 71 of stem assembly 70 in FIG. 7. A channel 511 in FIG. 8 is placed for communicating between the upper chamber 51 and the large opening 513. This channel is for placing an upper member 71 in FIG. 10 of a stem assembly 70 to control the valve. The lower chamber 52 in FIG. 8 is located on the bottom of the threaded neck 55. It contains an inlet opening 528 leading to the inlet 1015 in FIG. 3 of controller 101. A thread 525 is located for placing the bottom cover 90 in FIG. 7 to seal the lower chamber.

The body 50 of the housing 45 in FIG. 7 can be separately built as a sole item. Then, it can be inserted into the body 1017 of the controller 101 to become consolidated as shown in FIG. 3. However, the body 50 of the housing 45 in FIG. 7 can be infused to the body 1017 of the controller 101, forming a single composition. The infused embodiment structure has the internal vertical shut-off valve system built directly into the body 1017 of the controller 101. This solitary formation into a plastic made body reduces a manufacturing cost and simplifying the assembly process. However, it holds less durability than the separate metal housing incorporated into the plastic made body. A variety of production can be possible using a mixture of different material, structure, and design without departing the scope of protection.

Figure 9:
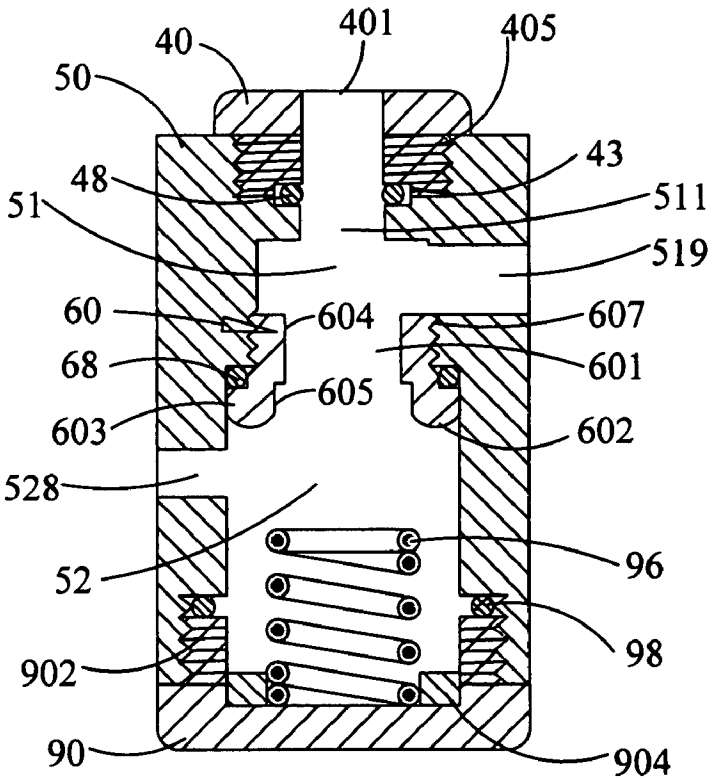
FIG. 9 is a cross-sectional view of FIG. 8 with the internal components assembled.

A seat 60 in FIG. 7 has an opening 601 in the middle wherein an upper member 71 of the stem assembly 70 and the released fluid are passed through. It is assembled to the housing 50 with an O-ring 68 to seal as shown in FIG. 9. The opening 601 of the seat 60 in FIG. 9 has two different sizes of diameters aligned: one with a small diameter 604 and the other with a large one 605. The small opening 604 takes a polygon shape to make it easy to assemble and disassemble using a tool. The large opening 605 in FIG. 9 takes a round shape for placing a flange 716 in FIG. 10 of the upper member 71. The outer surface of the seat 60 has a mean for fastening to the housing 50 such as thread 607 as shown in FIG. 9. An outer flange 603 in FIG. 9 is located next to the thread 607 to apply pressures onto an O-ring 68 to seal. A lip 602 in FIG. 9 of the seat 60 takes a rounded surface for easy engagement with an O-ring 78 in FIG. 11 of a stem assembly 70 to control fluid flowing through the opening 601. The opening 601 in FIG. 9 of the seat 60 is a channel for the pressured fluid at the inlet 528 to be discharged from the lower chamber 52 to the upper chamber 51, and for the upper member 71 of the stem assembly 70 to be passed through.

Figures 10, 11, 11A:
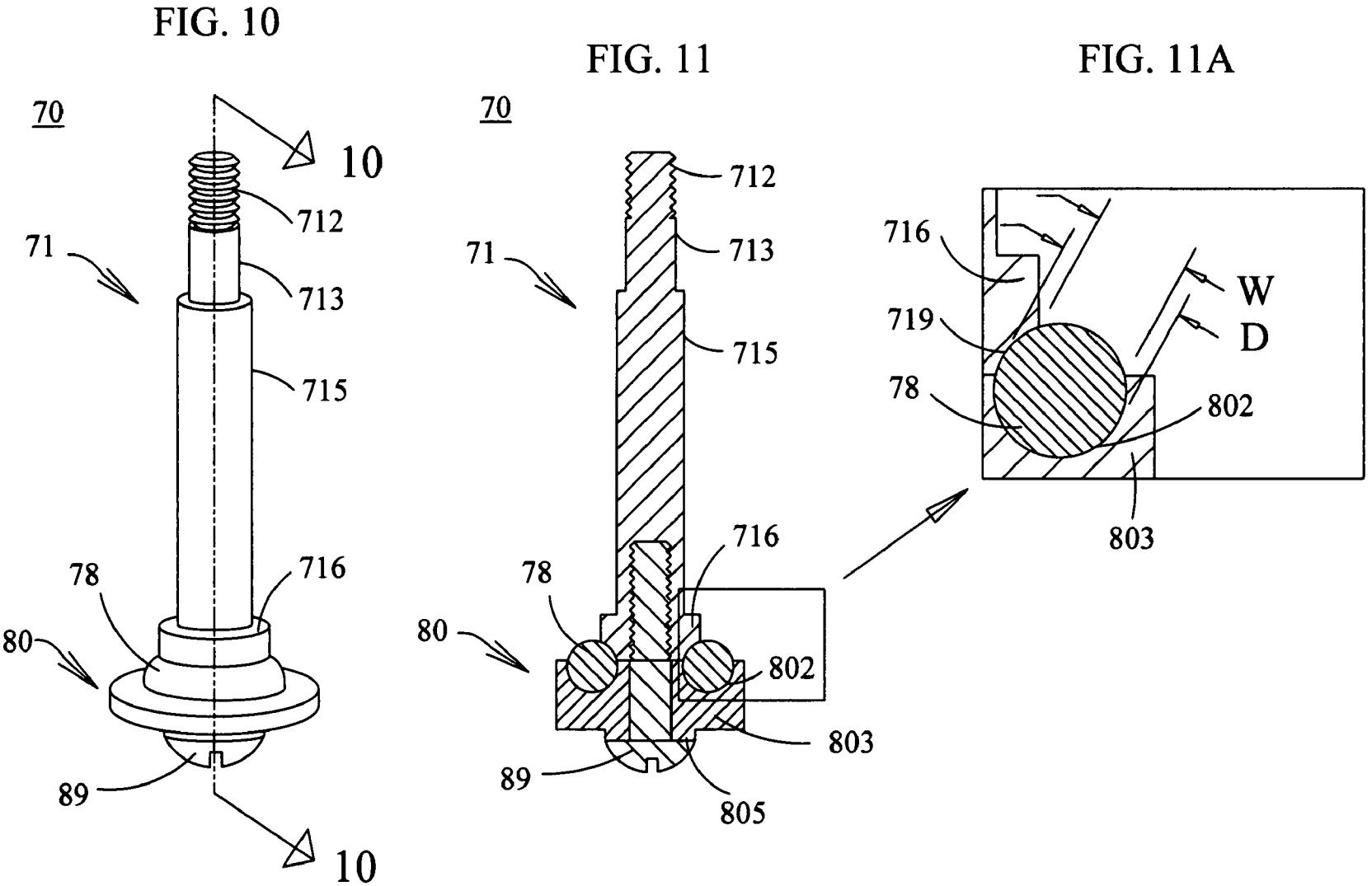
FIG. 10 is a prospective view of a stem assembly wherein an O-ring is placed between an upper member and a base plate secured by a fastener.
FIG. 11 is a cross-sectional view of the stem assembly taken on the line 10—10 in FIG. 10 showing the internal structure of assembled components.
FIG. 11A is a fragmentary enlargement of FIG. 11 showing details of O-ring, wherein the O-ring is mostly enclosed in the grooves of an upper member and a base plate, and is partially exposed for engagement with a seat.

The stem assembly 70 in FIG. 7 is composed of an upper member 71, an O-ring 78, a base plate 80, and a securing fastener 89. All of these components are assembled together, working as one distinctive piece as shown in FIG. 10. The upper piece 71 in FIG. 10 of stem assembly 70 comprises a flange 716, a shank 715, a shoulder 713, and a thread 712. The flange 716 supports an O-ring 78 in the groove 719 in FIG. 11A to keep in the place. This flange 716 furthermore guides and stabilizes a movement of the stem assembly 70 in the large opening 605 of the seat 60 in FIG. 9. Its round shape allows the stem assembly 70 to be placed into the large opening 605 of the seat 60 with any direction. The shank 715 in FIG. 10 extends its length to the outside of the valve housing 45 as shown in FIG. 4. Its smooth and round surface contributes good sealing with an O-ring 48 in FIG. 9 in the contact area. The shoulder 713 in FIG. 10 is for placing a pushbutton 30 in FIG. 7. The thread 712 in FIG. 10 is for a nut 304 in FIG. 7 to lock the pushbutton 30. The O-ring 78 in FIG. 7 is located under the flange 716 in FIG. 10 to stop flow of fluid when it is in engagement with the seat 60 in FIG. 9. Its round shape of thickness affords a good sealing with the round shape of lip 602 of the seat 60 in FIG. 9. The base plate 80 in FIG. 7 is located under the flange 716 in FIG. 10 to keep the O-ring 78 in the place. A groove 802 in FIG. 11 on the base plate 80 is made for better securing the O-ring 78. A bulging element 805 in FIG. 11 of the base plate 80 is for holding a compression spring 96 in FIG. 7 in the place. The base plate 80 in FIG. 11 has a large surface area 803 for absorbing the pressures from the inlet fluid source. The surface area 803 is adjustable to regulate the force for operation. The absorbed pressures are then released to add to the compression spring force, biasing the shut-off valve in the closed position.

The O-ring 78 in FIG. 7 becomes deformed or displaced because of the pressures delivered from the pressurized inlet fluid and the compression spring 96, reducing its performance. To ease this problem, the groove 719 in FIG. 11A on the flange 716 and the groove 802 on the body 803 of the base plate 803 are implemented and their surround shapes are to be rounded to enclose the O-ring 78. These rounded shapes of grooves 719, 802 afford the maximum supportive areas to the O-ring 78. Therefore, the pressures are distributed over the maximum supportive areas, minimizing the deformation of the O-ring 78. Besides, the exposed width W of the O-ring 78 in FIG. 11A should be smaller than the thickness D to prevent its displacement. As shown in FIG. 11A, if the exposed width is nominated W and the thickness is nominated D, then the relations between W and D are formulated as the following:

$$W<D$$

to keep the O-ring 78 in the place for the proper function of the stem assembly 70.

The difference between the exposed width W and thickness D of the O-ring 78 determines stability of the O-ring 78 placed in the grooves 719, 802 in FIG. 11A. However, the meaning of this absolute value of difference is less meaningful because it differs from the small thickness to the large thickness of the O-ring 78. Therefore, the difference ratio has more meaningful as a relative value based on the thickness of the O-ring 789, and it formulates as the follows:

$$\text{Relative Difference Ratio}=(D-W)/D$$

The bigger the difference ratio is, the more stable the O-ring is in the place without displacement. However, there are some more factors that affect the optimum difference ratio. One of the factors is that the exposed width W requires a minimum contact surface area with the seat 60 for a proper engagement. Another factor is the material of the O-ring that is made of. The softer material that the O-ring 78 is made of, the bigger the difference ratio should be placed to prevent the displacement of the O-ring 78.

A compression spring 96 in FIG. 7 is located in a slot of a bottom cover 90 as shown in FIG. 9. Its compression pressures in addition with the inlet fluid pressures urge the stem assembly 70 in the closed position. It should be made of a corrosion resistive material or be wrapped by elastic rubber because it is always in submerge state. The bottom cover 90 in FIG. 7 is placed for securing the lower chamber 52 in FIG. 8 and for supporting the compression spring 96 as shown in FIG. 9. A slot 904 of the bottom cover in FIG. 9 is for placing the compression spring 96 to prevent its dislocation. An O-ring 98 in FIG. 7 is placed to seal leakage from the lower chamber 52 through coupling area of the housing body 50 and the bottom cover 90 as shown in FIG. 9.

The top cover 40 in FIG. 7 above the housing 45 supports the stem assembly 70 for its movement through the opening 401. The top cover 40 in FIG. 9 has a male thread 405 to be assembled to the female thread 515 in FIG. 8 of the housing body 50. It also has a groove 43 underside as shown in FIG. 9 for placing an O-ring 48. The O-ring 48 seals the gap between the shaft 715 of the stem assembly 70 in FIG. 10 and the opening 401 in FIG. 9 of the top cover 40. The O-ring 48 seals its surrounding threaded area as well, as shown in FIG. 9. When the top cover 40 is tightened to cause the O-ring 48 to become deformation by the pressure, the hollow 43 in FIG. 9 on the top cover 40 together with the hollow 517 in FIG. 8 on the body 50 restrain the deformation of the O-ring 48 toward the outside. Therefore, these hollows 517, 43 are supporting to afford more pressures toward the shaft 715 within, affording better seal around. The pressures applied on the O-ring 48 should be adjustable with tightening motion of the top cover 40 in FIG. 9. The optimum amounts of pressures ensure the proper movement of the stem assembly 70 in FIG. 10 and leakage proof around the shaft 715 together with the thread 405 of the top cover 40. If the amounts of pressures are too high, the high pressures contribute a good sealing around the shaft 715 but cause a hard movement of the stem assembly 70 for operation. If the amounts of pressures are too low, the low pressures afford a soft movement of the stem assembly 70 but cause a poor sealing around the shaft 715.

The pushbutton assembly 30 in FIG. 7 comprises of a body 302, a lock nut 304, and a finish plug 306. The body 302 in FIG. 7 has a hole 308 in FIG. 12 for the shoulder 713 in FIG. 11 of the stem assembly 70 to place in. It has a large opening 307 in FIG. 12 to place the lock nut 304 on the male thread 712 in FIG. 11 of stem assembly 70. The lock nut 304 in FIG. 12 combines the stem assembly 70 to the body 302 of the pushbutton assembly 30 for manual operation. The body 302 of the pushbutton assembly 30 takes any shapes and colors for style and performance. However, the pressure-applied area of the body 302 should be large enough to offer comfortable operation of the stem assembly by the user. A groove 309 in FIG. 12 in the opening 307 is for securing the finish plug 306 that covers up the lock nut 304 and the opening 307. The lock nut 304 is preferably a nylon inserted locknut to resist its loosening from rotational movement of the stem assembly 70. The finish plug 306 is snapped in the opening 307 in such a way that its legs 3061 are secured in the groove 309 of the body 302. This finish plug 306 can be threadably attached to get the same purpose. The finish plug 306 that the actuating pressures are applied on requires the strength that the structure and the material should endure when operating the valve.

Figure 13:
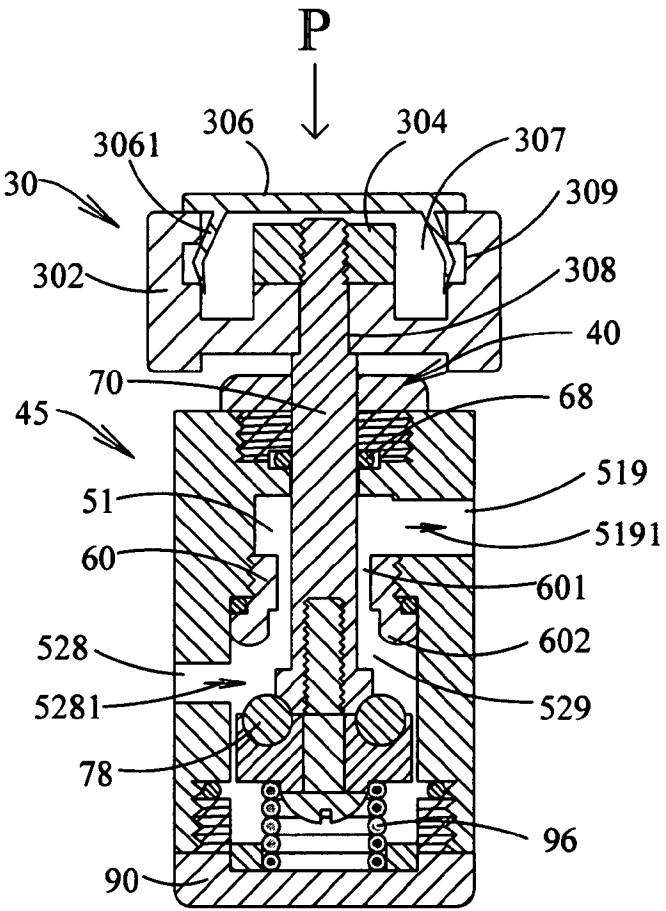
FIG. 13 is a cross-sectional view of the vertical shut-off valve taken on the line 4—4 in FIG. 4 showing the valve in an open position with a pushbutton being depressed by the external force P.
Figure 12:
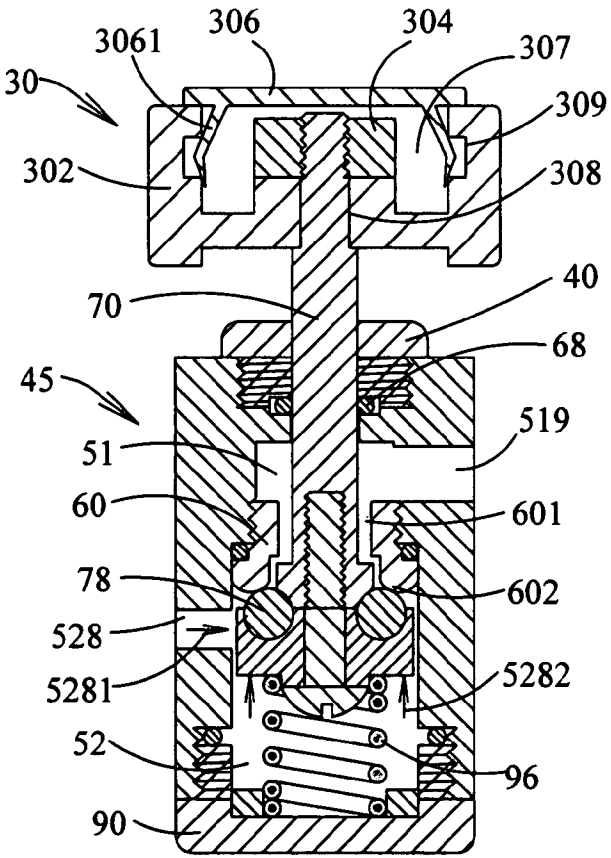
FIG. 12 is a cross-sectional view of the vertical shut-off valve taken on the line 44 in FIG. 4 showing the valve in a closed position with a pushbutton being freestanding.

When the user does not apply any pressures on the pushbutton assembly 30 in FIG. 12, the O-ring 78 of the stem assembly 70 is in engagement with the lip 602 of the seat 60, showing that there is no communication between the upper chamber 51 and the lower chamber 52. The spring 96 on the bottom cover 90 and the pressurized fluid 5282 in the lower chamber 52 are urging the stem assembly 70 against the lip 602 of the seat 602 to prevent the inlet flow 5281 toward the outlet 519 as shown in FIG. 12. However, when the user applies the pressures P in FIG. 13 on the pushbutton assembly 30, the stem assembly 70 gets lowered to make a passage 529 between the lip 602 of the seat 60 and the O-ring 78 of the stem assembly 70. The passage 529 allows the pressurized inlet fluid 5281 in the lower chamber 52 flowing through the opening 601 of the seat 60 to the upper chamber 51, releasing fluid 5191 through the outlet 519 as shown in FIG. 13. The released fluid 5191 includes low pressures, which enable the user to apply the quick connection for coupling of two components.

What I claim as my invention is:

1. A multi-purpose hand held sprayer having a vertical shut-off valve which comprises:

a controller regulating flow of the fluid and having an elongate body incorporating a vertical shut-off valve, an inlet including a coupler for communication with a pressurized fluid source, an outlet including an opening having an adapter arranged with multiple sizes of diameters for a quick connection, a channel that internally links for flow of the fluid from said inlet to said outlet through said vertical shut-off valve, and an exterior having a slim body for a hand grip and a contour on said body for being placed in a holder;

an extension bar carrying the fluid to a distant area and having a body being formed with a tubular shape, an inlet including an adapter arranged with multiple sizes of diameters for a quick connection to said outlet of controller, an outlet including an adapter arranged with multiple sizes of diameters for a quick connection, O-rings on said inlet and said outlet for a quick connection to afford sealing and friction, a channel that internally links for flow of the fluid from said inlet to said outlet and said outlet for spouting the fluid in a single stream, and an exterior contour on said body for being placed in a holder;

a spray tip performing distribution of the fluid in the air and having a body curved at various angles, an inlet including an adapter arranged with multiple sizes of diameters for a quick connection to said outlet of said extension bar, an outlet opening for releasing fluid having an internal base for placing an O-ring, a cover plate for said outlet opening contained various sizes and patterns of small holes for fine multiple streams of fluid, an O-ring placed in said outlet opening for said cover plate to seal, a chamber at said inlet offering a buffer for an occurrence that said inlet is not aligned with said outlet of said extension bar, a channel that internally links from said inlet through said chamber to said outlet.

2. A multi-purpose hand held sprayer having a vertical shut-off valve according to claim 1 wherein said vertical shut-off valve comprises:

a housing having a body including a lower chamber for input of pressurized fluid and an upper chamber for output of released fluid, an opening in said body locating above said upper chamber, a channel that links from said opening to upper chamber for a stem assembly passed through, an O-ring in said opening for sealing said channel, a top cover for said opening to apply pressures to said O-ring, a hollow in said opening for placing said O-ring to support sealing, an inlet opening in said lower chamber leading to said inlet of controller, an outlet opening in said upper chamber leading to said outlet of controller, a seat secured to said body between said lower chamber and said upper chamber, an O-ring for sealing said seat, a bottom cover for securing said lower chamber, an O-ring for sealing said bottom cover, a compression spring urging said stem assembly in a closed position located on said bottom cover;

a stem assembly being manually movable for controlling the fluid flowing from said lower chamber to said upper chamber;

a pushbutton assembly having a body including a hole for placing onto an upper member of said stem assembly, a locknut for securing said body to said upper member of stem assembly, an opening in said body for placing said locknut, a finish plug for covering said opening, and a groove in said opening for placing said finish plug.

3. A multi-purpose hand held sprayer having a vertical shut-off valve according to claim 2 wherein said stem assembly comprises:

an O-ring having a round hole in the middle, which is made of elastic material;

an upper member having a body extended to the outside of said controller for manual operation, a thread located on one end for placing said locknut in said pushbutton assembly, a shoulder for placing said body of pushbutton assembly, a shaft formulating a longitudinal, cylindrical, and slim outer shape with smooth surface for supporting a good sealing and having larger thickness than that of said shoulder to keep said pushbutton in the place, a flange located on the other end formulating a round disk for placing to fit into a large opening of said seat, a groove on said flange for placing said O-ring, and an opening for a fastener threaded internally from one end of said flange toward the said shaft;

a base plate having a body forming a round disk shape for absorbing inlet fluid pressures to deliver to said O-ring having a groove for placing said O-ring on one side, a protrude in the middle of the other side for placing said compression spring, and an opening in the center for a fastener run through from the middle of said protrude to the other side of said body;

a fastener to secure said O-ring placed between said upper member and said base plate, forming a solitary piece of said stem assembly for movement in said housing.

4. A multi-purpose hand held sprayer having a vertical shut-off valve according to claim 2 wherein said body of housing is being infused into said body of controller by means of composing internal structure of said vertical shut-off valve into said body of controller, making a solitary formation.

5. A multi-purpose hand held sprayer having a vertical shut-off valve according to claim 2 wherein said seat comprises:

a lip formulated a round smooth surface for good engagement with said O-ring of said stem assembly;

an opening having two sizes of diameters aligned in the middle for a passage of said stem assembly and the released fluid;

a polygon shape of said opening with a first small size diameter for a tool;

a round shape of said opening with a second large size of diameter for placing said upper member of stem assembly;

a flange on the outside of said seat for securing said O-ring to seal.

6. A multi-purpose hand held sprayer having a vertical shut-off valve according to claim 2 wherein said top cover comprises an opening in the middle for said stem assembly passed through, a hollow for placing said O-ring to support sealing against said shaft of stem assembly, a body including a thread to secure to said housing body, and means on said body for facilitating to adjust pressures applied on said O-ring.

7. A multi-purpose hand held sprayer having a vertical shut-off valve according to claim 2 wherein said bottom cover comprises a body including a thread to secure to said body of housing, a concave located in the middle for placing said compression spring to prevent misplacement, means on said body for facilitating to secure.

8. A multi-purpose hand sprayer having a vertical shut-off valve according to claim 6 or claim 7 wherein said means include various shapes including a polygon and any surface natures on said body including cross lines for facilitating to secure.

9. A multi-purpose hand held sprayer having a vertical shut-off valve according to claim 2 wherein the components of said vertical shut-off valve are preferably made of corrosion resistant material for longer usages.

10. A multi-purpose hand held sprayer having a vertical shut-off valve according to claim 3 wherein said O-ring of said stem assembly is enclosed in said grooves in such a way that the exposed width for engagement with said seat is not greater than the thickness of said O-ring to prevent displacement.

11. A multi-purpose hand held sprayer having a vertical shut-off valve according to claim 1 wherein said extension bar comprises a body having a slim and long shape to be placed in the limited space.

12. A multi-purpose hand held sprayer having a vertical shut-off valve according to claim 1 wherein said spray tip comprises a body having a slim shape with rounded end to be placed in the limited space.

13. A multi-purpose hand held sprayer having a vertical shut-off valve according to claim 1 wherein said O-rings made of elastic material for good sealing and friction.

14. A multi-purpose hand held sprayer having a vertical shut-off valve according to claim 1 wherein said quick connection is defined as coupling of an outlet of first member to an inlet of second member with sliding motion.

* * * * *